US006130651A

United States Patent [19]

Yanagisawa et al.

[11] Patent Number: 6,130,651

[45] Date of Patent: Oct. 10, 2000

[54] FOLDED ANTENNA

[75] Inventors: Wasuke Yanagisawa, Kita-ku; Tadashi Oshiyama; Hirotoshi Mizuno, both of Tomioka, all of Japan

[73] Assignee: Kabushiki Kaisha Yokowo, Tokyo, Japan

[21] Appl. No.: 09/174,535

[22] Filed: Oct. 19, 1998

[30] Foreign Application Priority Data

| | | | |
|---|---|---|---|
| Apr. 30, 1998 | [JP] | Japan | 10-136000 |
| Jul. 23, 1998 | [JP] | Japan | 10-223701 |

[51] Int. Cl.[7] ..... H01Q 1/36

[52] U.S. Cl. ..... 343/895; 343/702; 343/803

[58] Field of Search ..... 343/702, 895, 343/803, 806, 713, 715; 29/600

[56] References Cited

U.S. PATENT DOCUMENTS

| | | | |
|---|---|---|---|
| 3,231,894 | 1/1966 | Nagai | 343/806 |
| 4,381,566 | 4/1983 | Kane | 343/806 |
| 4,987,424 | 1/1991 | Tamura et al. | 343/806 |
| 5,517,206 | 5/1996 | Boone et al. | 343/806 |
| 5,793,333 | 8/1998 | Taniguchi et al. | 343/713 |

FOREIGN PATENT DOCUMENTS

| | | | |
|---|---|---|---|
| 0 755 091 A1 | 1/1997 | European Pat. Off. | H01Q 9/32 |
| 0 814 536 A2 | 12/1997 | European Pat. Off. | H01Q 9/42 |
| 10-013135 | 1/1998 | Japan . | |
| WO 97/49141 | 12/1997 | WIPO | H01Q 1/36 |
| WO 99/03166 | 1/1999 | WIPO | H01Q 1/24 |
| WO 99/22420 | 5/1999 | WIPO | H01Q 1/24 |

*Primary Examiner*—Tan Ho

*Attorney, Agent, or Firm*—Dickstein Shapiro Morin & Oshinsky LLP

[57] ABSTRACT

A conductor is provided from a base to a first fold point at the tip side, and sequentially folded parallel not less than once at the tip side and the base side, forming a first element; the conductor is split at the first fold point and the split conductor is, similarly, sequentially folded parallel not less than once at the tip side and the base side, forming a second element. Then, the effective length from the base to the tip of the first element is set to a quarter of the wavelength of a first frequency, and the effective length from the base to the tip of the second element is set to a quarter of the wavelength of a second frequency. Also provided is a folded antenna element, comprising a conductor in a direction from the base to the tip side, the conductor being folded at least once at the tip side and arranged parallel to the direction, is made cylindrical; a rod-like antenna element is provided so as to be freely movable in the axial direction of the folded antenna element; and, in an extended state, the base side of the rod-like antenna element becomes inserted to the tip side of the folded antenna element and is capacitance-coupled thereto by a large coupling capacitance. The effective length of the folded antenna element from the base to the tip is a quarter of the wavelength of the first frequency, and three quarters of the wavelength of the second frequency. In the extended state, the effective length from the base of the folded antenna element to the tip of the rod-like antenna element is a quarter of the wavelength of the first frequency, and three quarters of the wavelength of the second frequency.

26 Claims, 12 Drawing Sheets

FOLDED ANTENNA

BACKGROUND OF THE INVENTION

1. Field of the Invention

The present invention relates to a folded antenna wherein the physical length of along the axial direction of the antenna can be made short, adjustment of multiple resonant frequencies is easy, and transmitting and receiving at these multiple desired frequencies can be carried out with high gain. Furthermore, the present invention relates to an antenna device using the folded antenna, capable of standby-receiving at multiple desired frequencies and obtaining high antenna gain when in an extended state. Moreover, the present invention relates to a radio using the antenna device which is suitable for use in a dual band mobile telephone or the like.

2. Description of the Related Art

FIG. 19 shows an antenna device previously proposed by the present inventors in Japanese Patent Application No. 160016/1996. As shown in FIG. 19, this antenna device comprises a folded antenna 10, a whip antenna element 12 and a helical antenna element 14. The folded antenna 10 comprises a wire-like or belt-like conductor, which is provided along a direction from the base to the tip side, folded at the tip side parallel to the direction from the base to the tip side, and then folded again in parallel at the base side, ending with the tip facing the tip side. Then, the conductor is arranged in the shape of a cylinder having an axis in the direction from the base to the tip side. Furthermore, the helical antenna element 14 is provided on the tip of the whip antenna element 12 along the same axis and in a single body therewith, and this single body is freely extendable from and storable in the cylindrical folded antenna 10 along the axial direction thereof. Moreover, in the extended state, the base portion of the whip antenna element 12 is capacitance-coupled with the tip portion of the cylindrical folded antenna 10.

Then, the effective length of the folded antenna 10 from base to tip is set to a quarter of the wavelength of a first frequency f1. Here, as a result of floating capacitance between wires which have been folded parallel to each other, the folded antenna 10 acts as an antenna longer than its actual physical length. Furthermore, the effective length from the base to the first fold is set to a quarter of the wavelength of a second frequency f2, and the effective length from the base to the tip is set to three quarters of the wavelength of the second frequency f2. The second frequency f2 is higher than the first frequency f1, and as a result the floating capacitance between the parallel wires increases, thereby making the effective length even longer than the physical length. Therefore, the folded antenna 10, for which the first frequency f1 is resonant, can resonate the second frequency f2, which is lower than three times the first frequency f1. Then, as shown in FIG. 20, by setting the floating capacitance between parallel wires to an appropriate value, it is possible to set the second frequency f2 to approximately twice the first frequency f1.

Furthermore, the effective length from the base of the whip antenna element 12 to the tip of the helical antenna element 14 is set to half the wavelength of the first frequency f1, and the effective length from the base of the whip antenna element 12 to the tip thereof is set to half the wavelength of the second frequency f2.

As shown in FIG. 19, in this constitution, when the whip antenna element 12 and the helical antenna element 14 are extended from the folded antenna 10, at the first frequency f1, maximum voltage occurs at the tip of the folded antenna 10, and the base portion of the whip antenna element 12 and the tip of the folded antenna 10 become electrically connected at high frequency by a coupling capacitance C1, making it possible to transmit and receive at the first frequency f1. Furthermore, at the second frequency f2, maximum voltage occurs at the first fold point of the folded antenna 10, and the base portion of the whip antenna element 12 and the first fold point of the folded antenna 10 become electrically connected at high frequency by a coupling capacitance C2, making it possible to transmit and receive at the second frequency f2. At the second frequency f2, the helical antenna element 14 acts as a choke coil, not as an antenna. In the stored state, it is possible to transmit and receive at the first frequency f1 and the second frequency f2 using only the folded antenna 10.

When the first frequency f1 is set within a 900 MHz band and the second frequency f2 is set within a 180 MHz band, it is possible to transmit and receive at dual-band, such as GM/DCS or PDC/PHS, using a single antenna device. In this way, the previously proposed technology can also accommodate dual-band transmission and reception, and standby-reception in the stored state, and in addition, can obtain high gain antenna characteristics in the extended state.

However, in the previously proposed technology, the first frequency f1 and the second frequency f2 are both resonated by the folded antenna 10, comprising one conductor which is folded as appropriate. Consequently, when changing the physical length to the tip of the folded antenna 10, or the distance between the parallel wires or the length of the parallel portion, or the length to the first folding portion of the folded antenna 10, or the like, in order to adjust one of the resonant frequencies, there is an effect on the other resonant frequency, making it difficult to adjust the first frequency f1 and the second frequency f2 to desired frequencies. Furthermore, although the input/output impedances at the base of the folded antenna 10 can be adjusted by adjusting the coupling capacitances C1 and C2, it is difficult to adjust them individually, and consequently difficult to adjust them both to an optimum level. Moreover, since the length from the base to the first fold point is specified to a quarter of the high frequency (namely, the second frequency f2), the folded antenna 10 cannot be made shorter in the axial direction.

SUMMARY OF THE INVENTION

The present invention has been realized to further improve the technology proposed previously and aims to provide a folded antenna, wherein multiple resonant frequencies can be adjusted individually and the length of the antenna along its axis can be made shorter.

Furthermore, it is an object of the present invention to provide an antenna device using the antenna, which can obtain high antenna gain when the antenna is extended and can standby for receiving when the antenna is stored.

Furthermore, it is another object of the present invention to provide a radio using the antenna device, which is suitable for a dual-band mobile telephone and the like.

Furthermore, it is another object of the present invention to provide a freely extendable and storable antenna in which the total length when stored can be made shorter.

Furthermore, it is yet another object of the present invention to provide a radio, using the freely extendable and storable antenna, which can easily be made small.

In order to achieve the above objects, the folded antenna of the present invention comprises: a first element, comprising a wire-like or belt-like conductor which is provided in a direction from a base of the antenna toward a tip side thereof, the conductor being folded at least once at the tip side and arranged parallel to the direction; a second element, comprising the conductor which is split at a point between the base and a first fold point at the tip side, or at the first fold point, and folded at least once and arranged parallel to the direction; the effective length from the base to a tip of the first element being set so that a first frequency resonates, and the effective length from the base to a tip of the second element being set so that a second frequency resonates.

Furthermore, the folded antenna of the present invention may comprise a first element, comprising a wire-like or belt-like conductor which is provided in a direction from the base of the antenna toward the tip side thereof, the conductor being folded sequentially not less than once at the tip side and at the base side and arranged parallel to the direction; a second element, comprising the conductor which is split at a point between the base and a first fold point at the tip side, or at the first fold point, and folded sequentially not less than once at the tip side and the base side and arranged parallel to the direction; the effective length from the base to the tip of the first element being set so that a first frequency resonates, and the effective length from the base to the tip of the second element being set so that a second frequency resonates.

Furthermore, a freely extendable and storable antenna of the present invention comprises a folded antenna element, comprising a wire-like or belt-like conductor which is provided in a direction from the base toward the tip side, the conductor being folded at least once at the tip side and arranged parallel to the direction, the effective length from the base to the tip of the folded antenna element being set to a quarter of a wavelength of a first frequency and three quarters of a wavelength of a second frequency; a rod-like antenna element, provided so as to be freely movable along the axis direction of the folded antenna element, which is given a cylindrical shape; wherein, when the rod-like antenna element is in an extended state, the base side of the rod-like antenna element is capacitance-coupled to the tip side of the cylindrical shape of the folded antenna element in a state of insertion therein, the effective length from the base of the folded antenna element to the tip of the rod-like antenna element being set to a quarter of a wavelength of the first frequency and three quarters of a wavelength of the second frequency.

Furthermore, the freely extendable and storable antenna of the present invention comprises a folded antenna element, comprising a first element, which comprises a wire-like or belt-like conductor provided in a direction from the base toward a tip side, the conductor being folded at least once at the tip side and arranged parallel to the direction, and a second element, which comprises the conductor split at a point between the base and a first fold point at the tip side, or at the first fold point, and folded at least once and arranged parallel to the above direction, the effective length of the folded antenna element from the base to the tip of the first element being set to a quarter of a wavelength of a first frequency, and the effective length from the base to the tip of the second element being set to a quarter of a wavelength of a second frequency; and a rod-like antenna element, provided so as to be freely movable along the axial direction of the folded antenna element, which is given a cylindrical shape; wherein, when the rod-like antenna element is in an extended state, the base side of the rod-like antenna element is capacitance-coupled to the tip side of the cylindrical folded antenna element in a state of insertion therein, the effective length from a base of the folded antenna element to the tip of the rod-like antenna element being set to a quarter of a wavelength of the first frequency and three quarters of a wavelength of the second frequency.

DESCRIPTION OF THE PREFERRED EMBODIMENTS

Figure 1:
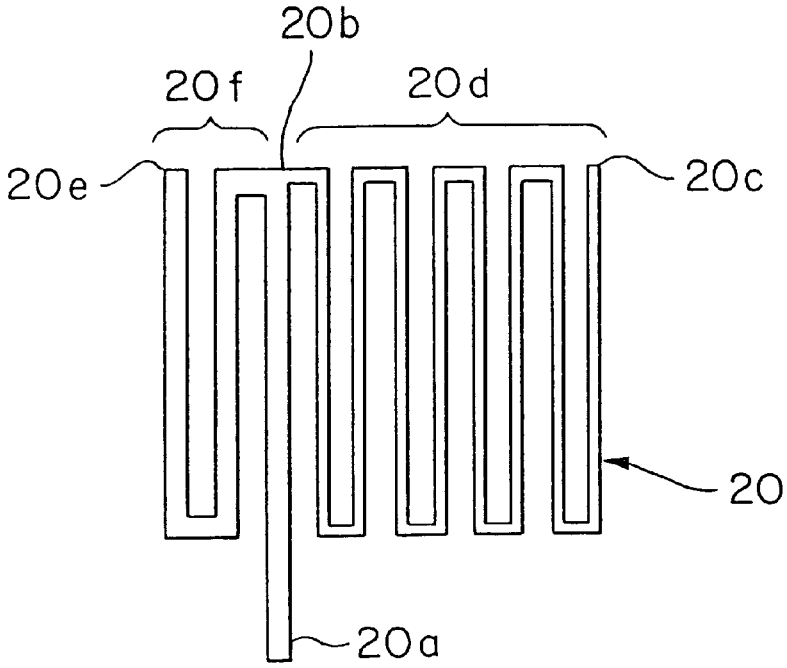
FIG. 1 is an unfolded view of a first embodiment of the folded antenna of the present invention.

FIG. 1 shows a folded antenna 20 comprising a wire-like or belt-like conductor, which is arranged along a direction having an axis from the base 20*a* to the antenna tip side, spitting into two parts at the tip side, one of the two parts being folded at a first fold point 20*b* and arranged parallel to the axis, then sequentially folded parallel at the tip side and the base side, continuing in zigzag at a right angle to the axis, and ending with the tip 20*c* facing the tip side. The portion from the first fold point 20*b,* where the conductor splits, to the tip 20*c* constitutes a first element 20*d,* and the effective length from the base 20*a* to the tip 20*c* of the first element 20*d* is set to a quarter of the wavelength of a first frequency f1. Furthermore, the other part of the split conductor is similarly folded and arranged parallel to the axis, folded again at the base side and arranged parallel to the axis, then sequentially folded parallel at the tip side and the base side, continuing in zigzag at a right angle to the axis, and ending with the tip 20*e* facing the tip side. The portion from the first fold point 20*b,* where the conductor splits, to the tip 20*e* constitutes a second element 20*f,* and the effective length from the base 20*a* to the tip 20*e* of the second element 20*f* is set to a quarter of the wavelength of a second frequency f2.

Figure 2:
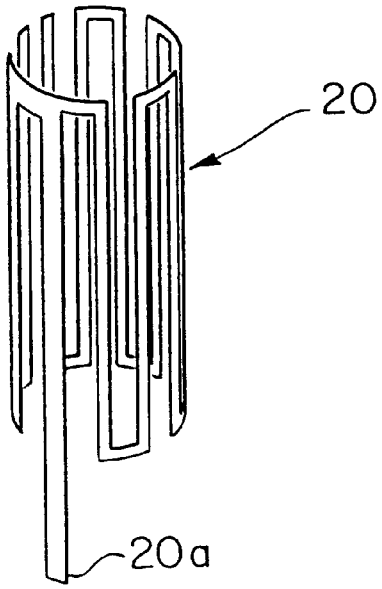
FIG. 2 is an external perspective view of the folded antenna of the first embodiment in FIG. 1 in a cylindrical arrangement.

Then, as shown in FIG. 2, the folded antenna 20 of FIG. 1 is provided in a cylindrical arrangement around an axis in the direction from the base 20*a* to the tip side. This cylindrical folded antenna 20 may be formed by providing the conductor shown in FIG. 1 on a flexible substrate, using an appropriate technique such as etching or vapor deposition, and winding this around the outer face of a cylindrical core member or the like made from insulating material. Alternatively, a conductor of the shape shown in FIG. 1 may be stamped from a copper plate, or the like, and bent into a cylindrical shape. Or, the conductor shown in FIG. 1 may be provided as appropriate by plating, or the like, of the outer face of a cylindrical core member.

The folded antenna 20 may comprise seal material. Seal material is created by sticking copper foil on carrier tape. The seal material is press-stamped into element shape. Consequently, unwanted copper foil is removed together with the carrier tape. Then, a covering tape is pasted over the seal material which has been stamped into element shape.

The element-shaped copper foil, which covering tape has been pasted to, is pasted to the face of a cylindrical core member. An adhesive which sticks easily to the core member is applied beforehand to the covering tape and the paste surface of the copper foil, whereby pasting can be performed in a simple operation and manufacturing costs can be reduced. Furthermore, according to this method, since the dimensions of the finished folded antenna are stable, electrical characteristics can be made constant, bringing an advantage that less adjustment is subsequently required.

Figure 19:
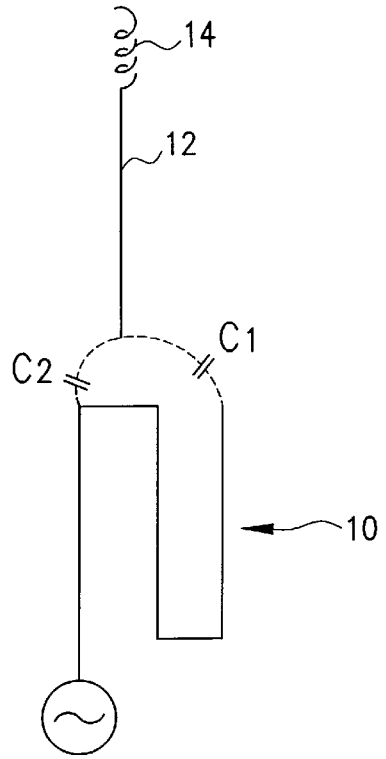
FIG. 19 (PRIOR ART)
FIG. 19 is an equivalent circuit diagram of an extended state of an antenna device previously proposed by the present inventors.
Figure 20:
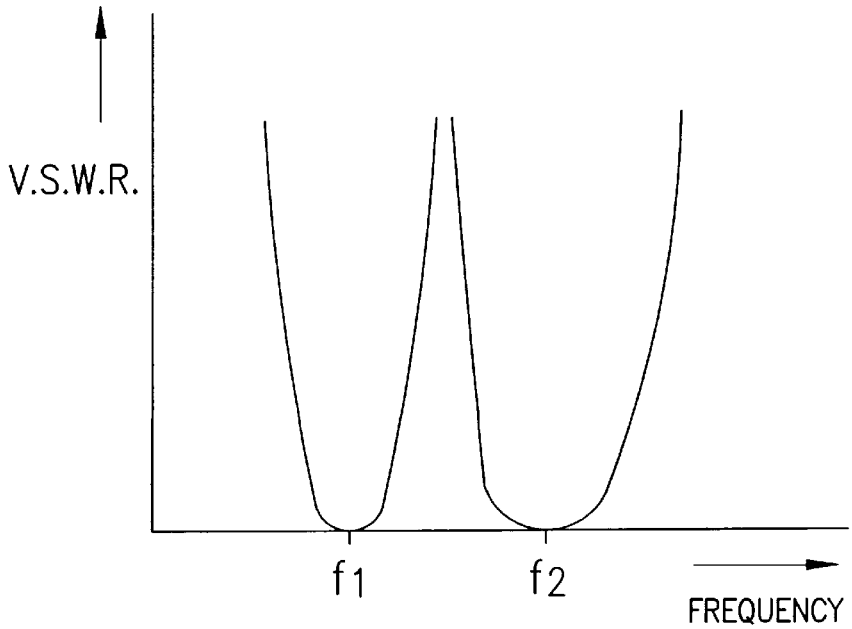
FIG. 20 (PRIOR ART)
FIG. 20 is a diagram illustrating antenna characteristics of a folded antenna used in the previously proposed antenna shown in FIG. 19.

In the folded antenna 20 of the above constitution, dimensions of the first element 20*d* such as the unfolded length, the distance between the parallel wires, the parallel length and the like, are set as appropriate so that a first resonant frequency f1 can be adjusted to a desired frequency. And, dimensions of the second element 20*f* such as the unfolded length, the distance between the parallel wires, the parallel length and the like, are set as appropriate so that a second resonant frequency f2 can be adjusted to a desired frequency. As a result, when the first element 20*d* is adjusted, there is no effect on the second frequency f2; and when the second element 20*f* is adjusted, there is no effect on the first frequency f1. Therefore, the elements 20*d* and 20*f* can be adjusted independently of each other. Thus, in comparison with the previously proposed folded antenna 10 shown in FIG. 19, the operations of adjusting the first frequency f1 and the second frequency f2 can be more easily performed with the folded antenna 20 of the present invention. As shown in FIG. 2, since the folded antenna 20 is provided in a cylindrical shape, it can be made smaller and the same shape as a helical antenna, but is also able to transmit and receive at the first frequency f1 and the second frequency f2, even when in the unfolded state shown in FIG. 1. Here, the effective lengths from the base 20*a* to the tip 20*c* and to the tip 20*e* are not restricted to a quarter of the wavelength of the resonant frequencies, and they may acceptably be odd multiples of one quarter wavelength, such as three quarters. Furthermore, an odd multiple of one eighth wavelength, or an odd multiple of a half wavelength of a resonant frequency, are also acceptable. Then, if the effective lengths from the base 20*a* to the tips 20*c* and 20*e* are, for the first and second frequencies f1 and f2, an odd multiple of a three-quarter wavelength, or an odd multiple of one eighth wavelength, or an odd multiple of a half wavelength, the input/output impedance at the base 20*a* will be substantially the same for the first and second frequencies f1 and f2. Consequently, no adjusting circuit is needed to make the input/output impedance at the base 20*a* the same for the first and second frequencies f1 and f2. In addition, when there is no need to consider the input/output impedances at the base 20*a,* adjustment multiples for the resonant frequencies may acceptably be one eighth, one quarter or one half wavelength. Then, when input/output impedances at the base 20*a* for the first and second frequencies f1 and f2 differ from each other, a circuit for adjusting inductance or the like may be provided at the base 20*a* and, using the inductance difference caused by the difference in the frequencies, the input/output impedances of the adjusting circuit can be made substantially the same.

Figure 3:
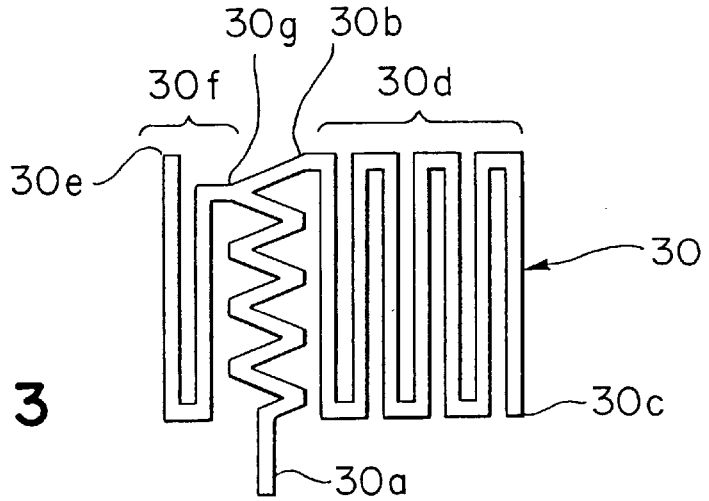
FIG. 3 is an unfolded view of a second embodiment of the folded antenna of the present invention.

FIG. 3 is an unfolded view of a second embodiment of the folded antenna of the present invention. As shown in FIG. 3, the folded antenna 30 of the second embodiment comprises a conductor which is provided in zigzag-shape along the axial direction between the base 30*a* to the first fold point 30*b*. Furthermore, the conductor splits into two parts at a place between the base 30*a* and the first fold point 30*b,* and the split conductor is folded at a split point 30*g* and arranged parallel to the axis. The portion from the first fold point 30*b* to the tip 30*c* constitutes a first element 30*d,* and the portion from the split point 30*g* to the tip 30*e* constitutes a second element 30*f*. Then, the effective length from the base 30*a* via the first fold point 30*b* to the tip 30*c* is set to a quarter of the wavelength of a first frequency f1, and the effective length from the base 30*a* via the split point 30*g* to the tip 30*e* is set to a quarter of the wavelength of a second frequency f2.

In the same manner as the folded antenna 20 of FIG. 1, the folded antenna 30 having the above constitution acts as an antenna capable of transmitting and receiving at the first frequency f1 and the second frequency f2. By providing a zigzag-shaped conductor between the base 30*a* and the first fold point 30*b,* the overall length of the antenna in the axial direction can be made shorter than the folded antenna 20 shown in FIG. 1. If the folded antenna 30 is to be used independently, the tip 30*c* of the first element 30*d* need only be provided facing the base side as in FIG. 3.

Figure 4:
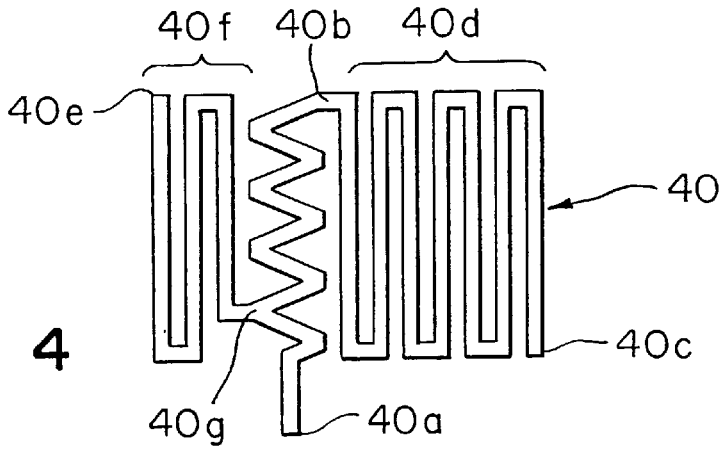
FIG. 4 is an unfolded view of a third embodiment of the folded antenna of the present invention.

FIG. 4 is an unfolded view of a third embodiment of the folded antenna of the present invention. As shown in FIG. 4, in the folded antenna 40 of the third embodiment, the split point 40*g* is positioned closer to the base 40*a* side. In FIG. 4, the English lower case letters accompanying the reference numerals correspond to like parts of FIG. 1–FIG. 3, and repeated explanation is avoided. The same applies in FIG. 5–FIG. 7 below.

Figure 5:
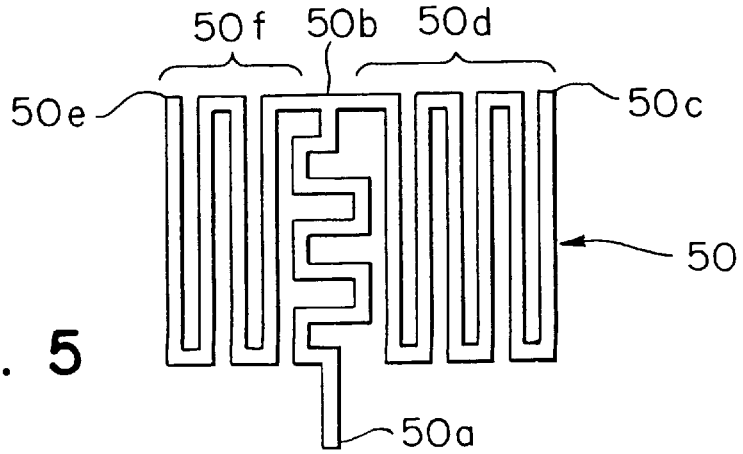
FIG. 5 is an unfolded view of a fourth embodiment of the folded antenna of the present invention.

FIG. 5 is an unfolded view of a fourth embodiment of the folded antenna of the present invention. As shown in FIG. 5, in the folded antenna 50 of the fourth embodiment, the conductor is provided from the base 50*a* to the first fold point 50*b* in a zigzag shape running parallel to the axis, and each of the zigzags bends at 90 degrees. Alternatively, these zigzags may bent into U-shapes to form a snake-like arrangement.

Figure 6:
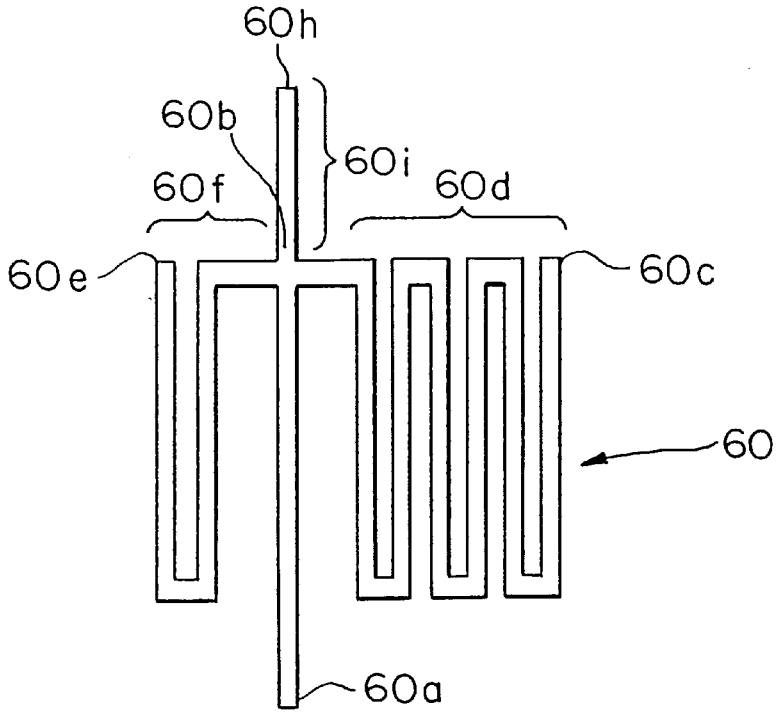
FIG. 6 is an unfolded view of a fifth embodiment of the folded antenna of the present invention.

FIG. 6 is an unfolded view of a fifth embodiment of the folded antenna of the present invention. In the folded antenna 60 of the fifth embodiment in FIG. 6, the conductor splits into three parts at the first fold point 60*b*. Two of the split conductor parts constitute a first element 60*d* and a second element 60*f*, as in the first embodiment. The remaining part of the split conductor continues in the axial direction and constitutes a third element 60*i*, which runs from the first fold point 60*b* to the tip 60*h*. Then, the effective length from the base 60*a* to the tip 60*c* of the first element 60*d* is set to a quarter of the wavelength of a first frequency f1, the effective length from the base 60*a* to the tip 60*e* of the second element 60*f* is set to a quarter of the wavelength of a second frequency f2, and the effective length from the base 60*a* to the tip 60*h* of the third element 60*i* is set to a quarter of the wavelength of a separate third frequency f3. As a result, the folded antenna 60 of the sixth embodiment is able to transmit and receive at three frequencies: the first frequency f1, the second frequency f2 and the third frequency f3.

Figure 7:
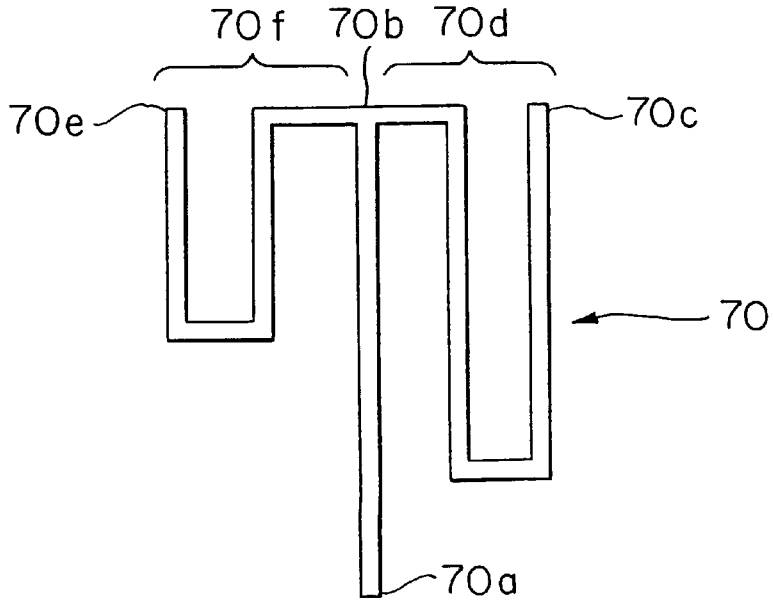
FIG. 7 is an unfolded view of a sixth embodiment of the folded antenna of the present invention.

FIG. 7 is an unfolded view of a sixth embodiment of the folded antenna of the present invention. In FIG. 7, the effective length of the folded antenna 70 of the sixth embodiment from the base 70*a* to the first fold point 70*b* is set at a quarter of the wavelength of a separate fourth frequency f4, and in addition, the effective length from the base 70*a* to the tip 70*c* of the first element 70*d* is set at three quarters of the wavelength of the fourth frequency f4. The folded antenna 70 of the sixth embodiment can transmit and receive at four frequencies: the first frequency f1, the second frequency f2, the third frequency f3 and the fourth frequency f4.

Figure 8:
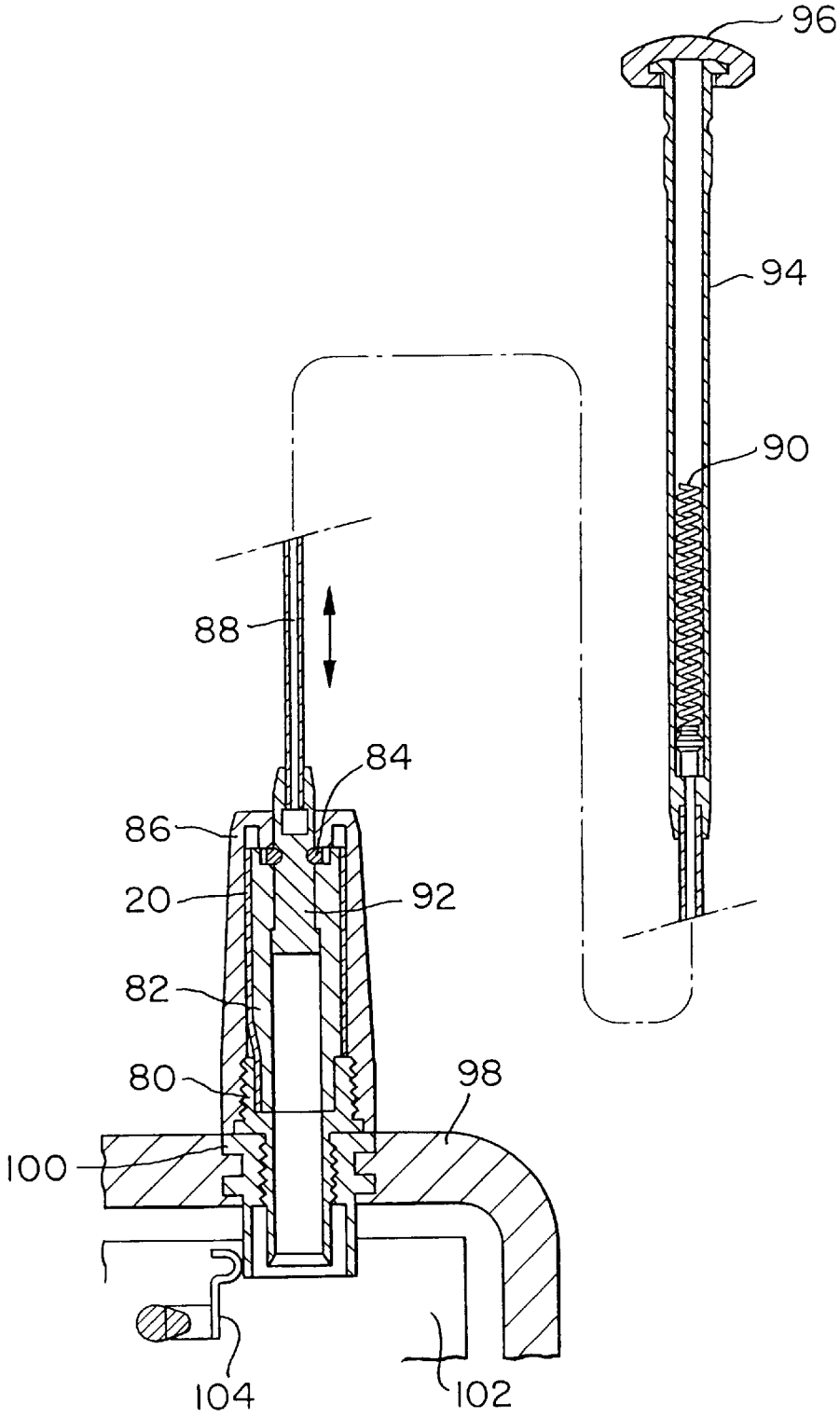
FIG. 8 is a vertical sectional view of primary parts of an embodiment of a radio of the present invention.
Figure 9A:
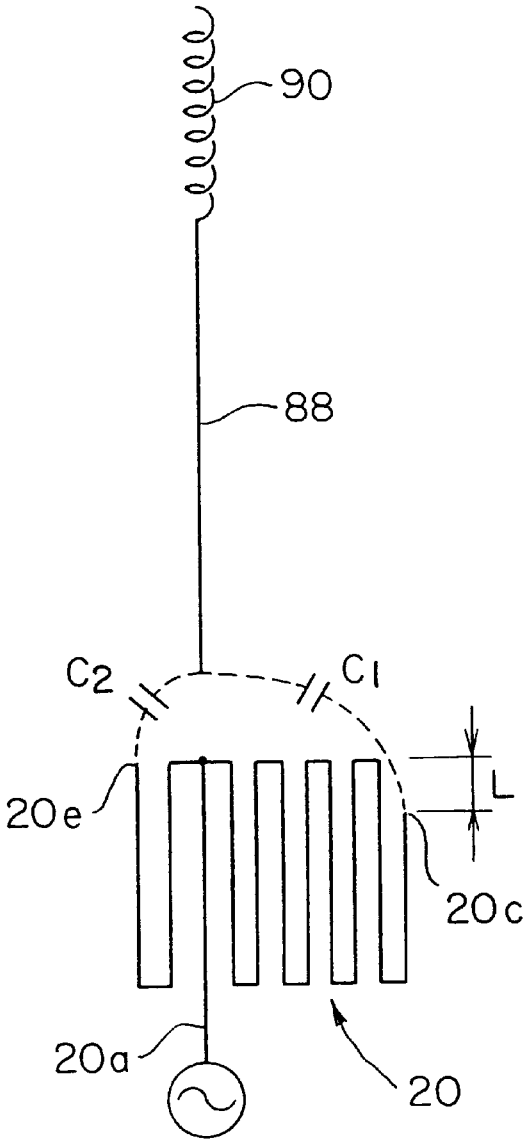
FIG. 9*a* and FIG. 9*b* are equivalent circuit diagrams of an antenna device of the radio in FIG. 8, FIG. 9*a* illustrating an extended state, and FIG. 9*b,* a stored state.
Figure 9B:
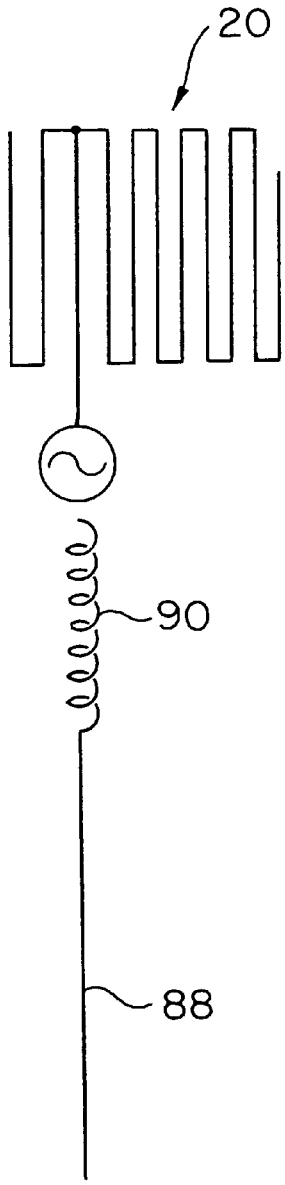
Figure 10:
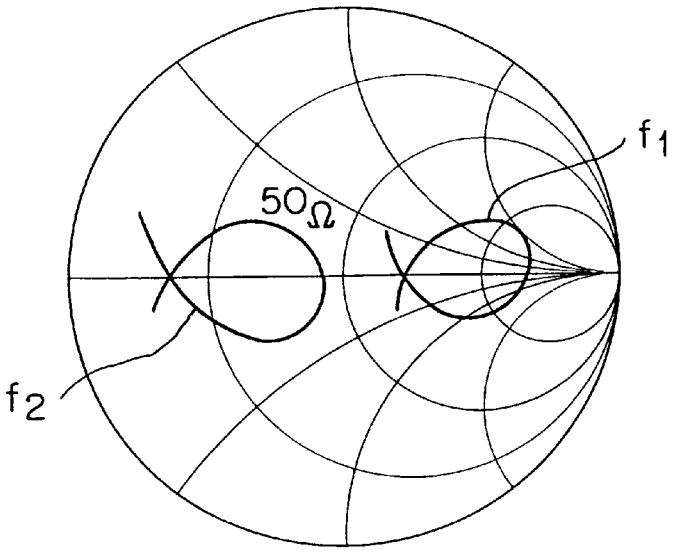
FIG. 10 is an example of a Smith chart showing input/output impedances at a first frequency and a second frequency in the antenna device of FIG. 9.
Figure 11:
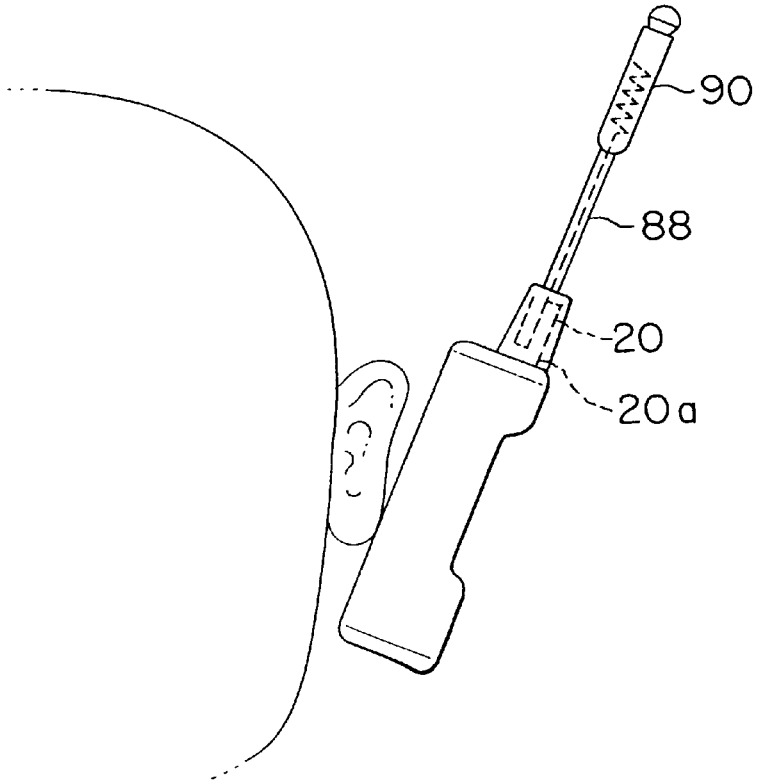
FIG. 11 is a diagram showing an example in which a folded antenna is provided to a radio cabinet to improve SAR.

Next, a radio using the folded antenna of the present invention will be explained with reference to FIG. 8–FIG. 11. FIG. 8 is a vertical sectional view of primary parts of an embodiment of a radio of the present invention. FIG. 9 shows equivalent circuit diagrams of an antenna device of the radio in FIG. 8, FIG. 9*a* illustrating an extended state, and FIG. 9*b*, a stored state. FIG. 10 is an example of a Smith chart showing input/output impedance at a first frequency and a second frequency in the antenna device of FIG. 9. FIG. 11 is a diagram showing an example of providing a folded antenna to a radio cabinet to improve SAR (Specific Absorption Rate). A folded antenna according to any of the first to sixth embodiments already described can be used, but, by way of example, the following explanation uses the folded antenna of the first embodiment.

In FIG. 8, a cylindrical core member 82, comprising insulating material, is provided to the tip side of a roughly cylindrical supply-feeding feeding metal part 80, comprising conductive material, on the same axis thereto, and the folded antenna 20 of the first embodiment is wound around the outer face of the core member 82, with the base 20*a* electrically connected directly to the supply-feeding metal part 80 as appropriate. Furthermore, a C-shaped resin spring 84 is provided at the tip side of the core member 82, and a covering member 86, which covers the outer rim of the folded antenna 20 while allowing the resin spring 84 to move in the axial direction, is provided so that the base side of the covering member 86 securely screws onto the supply-feeding metal part 80. In addition, a helical antenna element 90 is electrically connected in the same axis to the tip of a whip antenna element 88, which comprises a flexible and conductive wire rod of NiTi or the like, thereby securing the two elements 90 and 88 in a single body. This single body can move freely along the axial direction of the supply-feeding metal part 80 and the core member 82, and can freely be extended and stored. A wide-radius stopper 92, comprising insulating material, is provided at the base portion of the whip antenna element 88 in order to stop the whip antenna element 88 from slipping out in the extend direction. In addition, a resin spring 84 clips into a groove provided around the outer rim of the stopper 92, elastically holding the whip antenna element 88 when in the extended state. Furthermore, a large-radius portion, having the same radius as the stopper 92, is provided to the tip side of a helical covering member 94, which comprises insulating material and covers the outer rim of the helical antenna element 90. The resin spring 84 clips into a groove provided around the outer rim of this large-radius portion, elastically holding the whip antenna element 88 when in the stored state. Then, a decorative head 96, having a wide radius, is provided on the tip of the helical covering member 94 to specify a predetermined position when moving in the store direction and to be used as a grip when extending. This completes the constitution of the antenna device using the folded antenna 20.

Furthermore, a supply-receiving member 100, comprising conductive material, is secured to a radio cabinet 98 by insert-molding or the like through a side wall thereof. Then, the supply-feeding metal part 80 of the antenna device is screwed into the supply-receiving member 100, whereby the antenna device is secured to the radio cabinet 98. Furthermore, a substrate 102, which a radio circuit is mounted on, is provided as appropriate inside the radio cabinet 98, and a plate spring 104 comprising a conductive material, which is provided to the substrate 102, elastically contacts a portion of the supply-receiving member 100 which projects into the radio cabinet 98. This plate spring 104 is, of course, electrically connected to the high frequency level of the radio circuit, and the supply-feeding metal part 80 of the antenna device is electrically connected to the radio circuit by the supply-receiving member 100 and the plate spring 104, thereby forming a radio.

Then, the effective length from the base 20*a* of the folded antenna 20 to one tip 20*c* is set to a quarter of a first frequency f1, and the effective length from the base 20*a* to the other tip 20*e* is set to a quarter of a second frequency f2. Furthermore, the effective length from the base of the whip antenna element 88 to the tip of the helical antenna element 90 is set at half a wavelength of the first frequency f1, and the effective length from the base of the whip antenna element 88 to the tip thereof is set to half a wavelength of the second frequency f2.

In this constitution, as shown in the extended state of FIG. 9 (*a*), at the first frequency f1, maximum voltage occurs at the tip 20*c* of the folded antenna 20, and this tip 20*c* and the base portion of the whip antenna element 88 are capacitance-coupled by a coupling capacitance C1, whereby the first frequency f1 resonates with high antenna gain. Furthermore, at the second frequency f2, maximum voltage occurs at the other tip 20*e* of the folded antenna 20, and this tip 20*e* and the base portion of the whip antenna element 88 are capacitance-coupled by a coupling capacitance C2, whereby the second frequency f2 resonates with high antenna gain. Here, since the first frequency f1 and the second frequency f2 of the folded antenna 20 are adjusted to resonate in an optimum state, the antenna device obtains high antenna gain at both first and second frequencies f1 and f2.

Now, in the antenna device shown in FIG. 9, input/output impedances with respect to the first frequency f1 and the second frequency f2 should preferably be approximately the same, and in addition, they should preferably be set to a desired value, for instance, approximately 50 ohms. But, as shown in FIG. 10, input/output impedance tends to be exceed the desired value at the low first frequency f1, and tends to be lower than the desired value at the high second frequency f2. These input/output impedance values increase as the values of the coupling capacitances C1 and C2 are increased to strengthen the extent of capacitance-coupling. Therefore, the tip 20*c,* on the side of the folded antenna 20 where the first frequency f1 is resonant, is provided lower than the tip position by a distance L, thereby reducing the coupling capacitance C1 between the tip 20*c* and the whip antenna element 88. As a result, the input/output impedance for the first frequency f1 can be reduced and adjusted to a desired value. Furthermore, if necessary, the tip 20*e* of the side where the second frequency f2 is resonant can be provided closer to the base portion of the whip antenna element 88 so as to increase the coupling capacitance C2, thereby increasing the input/output impedance for the second frequency f2. Thus, by setting the two tips 20*c* and 20*e* of the folded antenna 20 as appropriate and separately adjusting the coupling capacitance C1 and the coupling capacitance C2, the input/output impedances with respect to the first frequency f1 and the second frequency f2 can easily be set to roughly the same desired value, such as 50 ohms. To adjust the coupling capacitance C1 and the coupling capacitance C2, it is acceptable, not only to adjust the positions of the tips 20*c* and 20*e* with respect to the base portion of the whip antenna element 88, but also to adjust the opposing areas of the tips, and also to use components of appropriate permittivity for the portions corresponding to the core member 82 and the stopper 92.

Furthermore, as shown in FIG. 9(*b*), even when the antenna device of the present invention is in the stored state, the first frequency f1 and the second frequency f2 are resonated by the folded antenna 20, which is suitable for standby receiving and the like. Moreover, as described above, since the first frequency f1 and the second frequency f2 can easily be adjusted separately, a higher gain can be obtained at both the frequencies than with the conventional device, even during the stored state.

When the first frequency f1 is set within a 900 MHz band and the second frequency f2 is set within a 1800 MHz band, it is possible for a single antenna device to transmit and receive at dual band, such as GSM/DCS or PDC/PHS, as in the conventional device. In addition, antenna characteristics at the transmission and reception frequencies can be adjusted more easily than in the previously proposed technology, making the device more suitable to mass production.

Furthermore, as shown in FIG. 11, by altering the structure of FIG. 8, in which the supply-feeding metal part 80 of the antenna device is secured to the supply-receiving member 100 of the radio cabinet 98, to a structure in which the position of the antenna device about the axis is predetermined relative to the radio cabinet 98, the conductor, which is arranged from the base 20*a* of the folded antenna 20 to the first fold point 20*b,* may be provided on the side which is opposite to the side near the side of the user's head during use.

As shown in FIG. 11, when a mobile telephone is used close to the side of the user's head, by providing the folded antenna 20 to the radio cabinet 98, it is possible to greatly improve the SAR (Specific Absorption Rate) in comparison with the conventional device, where a helical coil was provided to the antenna, which projected outside in order to standby for receiving. The reason for this is as follows. Firstly, in both the extended state and the stored state, resonance of the first frequency f1 and the second frequency f2 causes maximum current flow at the base portion of the antenna device. Now, in the case of the conventional helical coil, the distance from the outer rim of the helical element to the side of the user's head is short, and there is a possibility that the magnetic field resulting from current flowing through the coil portion on this side may have a serious effect on the side of the user's head. By contrast, in the case of the folded antenna 20 of the present invention, maximum current flow occurs in the conductor between the base 20*a* and the first fold point 20*b,* which is on the side farthest from the side of the user's head. Consequently, the effects of the magnetic field, resulting from this flow of current, on the side of the user's head is greatly reduced. Tests confirmed that effects of such a magnetic field attenuate greatly as distance increases, and that even a slight increase in distance, resulting from a slight change of position, achieves a considerable reduction.

Figure 12A:
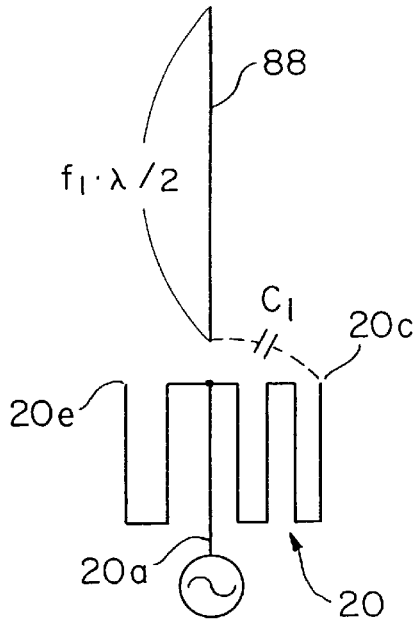
FIG. 12*a* and FIG. 12*b* are equivalent circuit diagrams of an antenna device according to another embodiment of the present invention in an extended state, FIG. 12*a* illustrating operation at a first frequency, and FIG. 12*b,* operation at a second frequency.
Figure 12B:
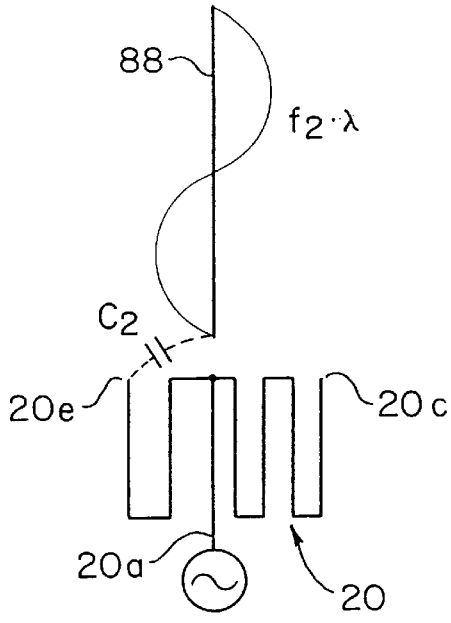

FIG. 12 shows equivalent circuit diagrams of an antenna device of another embodiment of the present invention in an extended state, FIG. 12(*a*) illustrating operation at the first frequency, and FIG. 12(*b*), operation at the second frequency.

As shown in FIG. 12, in the antenna device of another embodiment, the whip antenna element 88 is freely movable along the axial direction of the folded antenna 20 and can be freely extended and stored. The helical antenna element 90 of FIG. 9 is not provided. Here, when the first frequency f1 is set at a band of 900 MHz and the second frequency f2 is set at a band of 1800 MHz, the effective length of the whip antenna element 88 can be set to a half a wavelength for the first frequency f1, and one wavelength for the second frequency f2. As regards the folded antenna 20, the effective lengths from the base 20*a* to the tips 20*c* and 20*e* are both set to a quarter of the wavelength of the first and second frequencies f1 and f2.

As shown in FIG. 12(*a*), in the extended state, the quarter wavelength of the folded antenna 20 and the half wavelength of the whip antenna element 88 are capacitance-coupled by the coupling capacitance C1, whereby the first frequency f1 is resonant. Furthermore, as shown in FIG. 12(*b*), the quarter wavelength of the folded antenna 20 and the one wavelength of the whip antenna element 88 are capacitance-coupled by the coupling capacitance C2, whereby the second frequency f2 is resonant.

The antenna device of another embodiment shown in FIG. 12 can be applied when the second frequency f2 is twice the first frequency f1, for instance, 1800 MHz and 900 MHz respectively. Moreover, the technology of the antenna device of FIG. 12 can be applied when the second frequency f2 is an integral multiple (e.g. three times) of the first frequency f1.

Figure 13A:
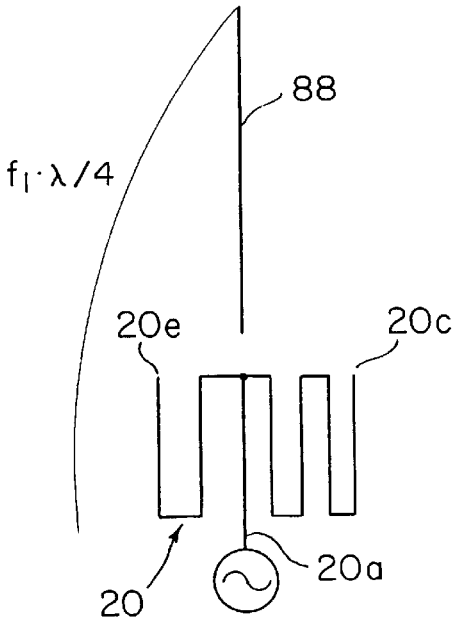
FIG. 13*a* and FIG. 13*b* are equivalent circuit diagrams of an antenna device of yet another embodiment of the present invention in an extended state, FIG. 12*a* showing operation at a first frequency, and FIG. 12*b,* operation at a second frequency.
Figure 13B:
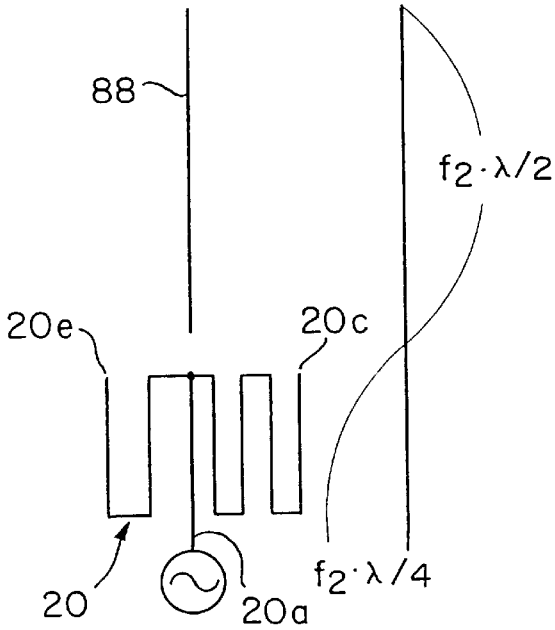

FIG. 13 shows equivalent circuit diagrams of an antenna device of yet another embodiment of the present invention in an extended state, FIG. 13(*a*) illustrating operation at the first frequency, and FIG. 13(*b*), operation at the second frequency.

As shown in FIG. 13, the antenna device of yet another embodiment is similar to that of FIG. 12 in that the whip antenna element 88 is freely movable along the axial direction of the folded antenna 20 and can be freely extended and stored, and the helical antenna element 90 of FIG. 9 is not provided. However, the operating state of the embodiment of FIG. 13 is different. In the extended state, the base portion of the whip antenna element 88 overlaps with the tip portion of the folded antenna 20, increasing the extent of capacitance-coupling. Furthermore, as shown in FIG. 13(*a*), for the first frequency f1, the effective length from the base 20*a* of the folded antenna 20 to the tip of the whip antenna element 88 is set to a quarter of the wavelength. And, as shown in FIG. 13(*b*), for the second frequency f2, the effective length from the base 20*a* of the folded antenna 20 to the tip of the whip antenna element 88 is set to three quarters of the wavelength. As regards the folded antenna 20, the effective lengths from the base 20*a* to the tips 20*c* and 20*e* are both set to a quarter of the wavelength of the first and second frequencies f1 and f2.

In this constitution, according to tests, current flowed to the coupling capacitance at the base of the whip antenna element 88 and operation was different from the antenna devices shown in FIG. 9 and FIG. 12. Therefore, we can assume that the inductance components of the folded antenna 20, the capacitance components of the coupling capacitance and the inductance components of the whip antenna element 88 resonate in series, whereby, as shown in FIG. 13(*a*) and FIG. 13(*b*), the first frequency f1 and the second frequency f2 both resonate.

In the explanation of the above embodiments, it can easily be understood that, if the supply-feeding metal part 80 and the plate spring 104 provide the antenna function for the antenna device and radio device, the base 20*a,* which acts as the antenna of the folded antenna 20, is not the physical base itself, but the connection point between the plate spring 104 and the substrate 102.

Figure 14A:
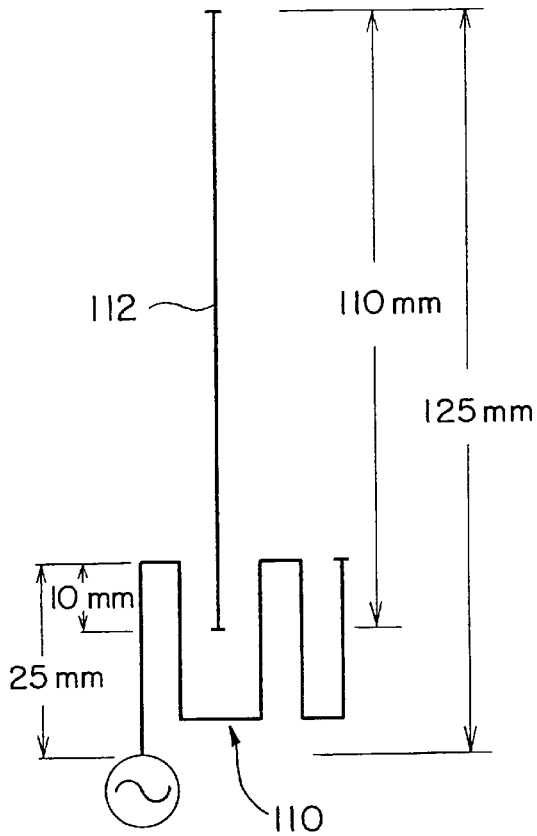
FIG. 14*a,* FIG. 14*b* and FIG. 14*c* are diagrams showing a first embodiment of the freely extendable and storable antenna of the present invention, FIG. 14*a* illustrating the extended state of the antenna, FIG. 14*b* illustrating the stored state of the antenna, and FIG. 14*c,* an equivalent circuit diagram of the extended state of the antenna.
Figure 14B:
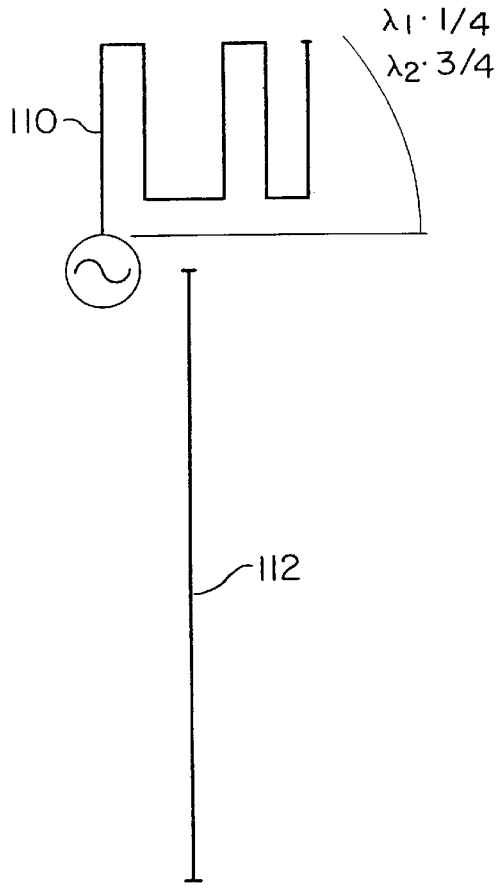
Figure 14C:
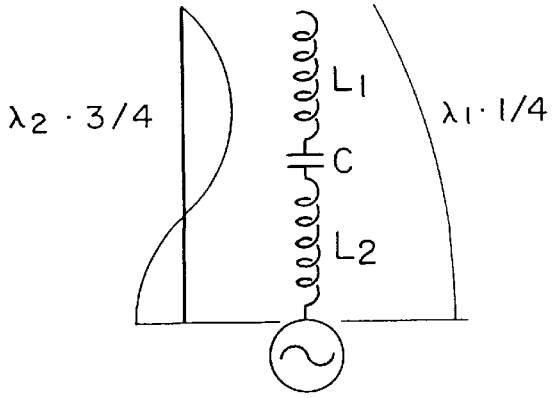
Figure 15:
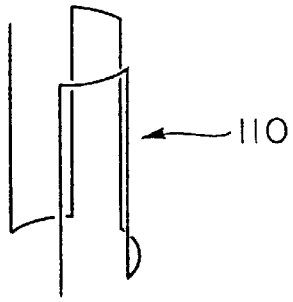
FIG. 15 is an external perspective view of an example of a cylindrical folded antenna element.

FIG. 14*a,* FIG. 14*b* and FIG. 14*c* are diagrams showing a first embodiment of the freely extendable and storable antenna of the present invention, FIG. 14*a* illustrating the extended state of the antenna, FIG. 14*b* illustrating the stored state of the antenna, and FIG. 14*c,* an equivalent circuit diagram of the extended state of the antenna. FIG. 15 is an external perspective view of one example of a cylindrical folded antenna element.

As shown FIG. 15, a folded antenna element 110 is cylindrical. Then, a rod-like antenna element 112 is provided on the same axis as the cylindrical folded antenna element 110 so as to be freely movable along the axial direction. The folded antenna element 110 of the first embodiment comprises a wire-like or belt-like conductor, provided in a direction from the base to the tip side, and this conductor is folded at least once at the tip side and arranged parallel to the above direction in a zigzag arrangement. Furthermore, the movement of the rod-like antenna element 112 in the extend direction and the store direction is, of course, restricted as appropriate to prevent the rod-like antenna element 112 from slipping out. In addition, according to the freely extendable and storable antenna of the present invention, in the extended state, the tip side of the folded antenna element 110 and the base side of the rod-like antenna element 112 overlap, creating an state wherein the base side of the rod-like antenna element 112 becomes inserted into the tip side of the folded antenna element 110, and as a consequence, movement in the extend direction is restricted.

Then, the effective length from the base to the tip of the folded antenna element 110 is set to a of the quarter wavelength of the first frequency f1 (wavelength λ1) and three quarters of the wavelength of the second frequency f2 (wavelength λ2). Furthermore, the dimension of the folded antenna element 110 from the base to the first fold point is, for instance, approximately 25 mm. Moreover, the dimension of the rod-like antenna element 112 is, for instance, 110 mm, with a 10 mm overlap with the tip side of the folded antenna element 110 when extended, and the dimension from the base of the folded antenna element 110 to the tip of the rod-like antenna element 112 when extended is approximately 125 mm. Here, as one example, the first frequency f1 is 900 MHz an the second frequency f2 is 1800 MHz.

As shown in the stored state of FIG. 14(*b*), according to the present constitution, since the first and second frequencies f1 and f2 are resonated by a single folded antenna element 110, standby-reception is possible. And, since the effective length of the folded antenna element 110 is a quarter of the wavelength of the first frequency f1 and three quarters of the wavelength of the second frequency f2, the input/output impedance in each case is approximately 50 ohms. In the stored state, since the tip portion of the rod-like antenna element 112 is sufficiently distant from the folded antenna element 110 to avoid any electrical coupling, the rod-like antenna element 112 does not function as an antenna, and therefore has no effect on antenna characteristics. Furthermore, in the stored state, even when the tip portion of the rod-like antenna element 112 is close enough to the folded antenna element 110 to cause capacity coupling or dielectric coupling therewith, the effective length from the base of the folded antenna element 110 to the base of the rod-like antenna element 112 need only be set so that frequencies within the frequency band of the first frequency f1 and the second frequency f2 are not resonant.

Furthermore, as shown in the extended state of FIG. 14(*a*), the tip portion of the folded antenna element 110 and the base portion of the rod-like antenna element 112 are capacitance-coupled by a coupling capacitance C of relatively high value. As shown in FIG. 14(*c*), the corresponding equivalent circuit is a series-resonant circuit comprising an inductance L1, the coupling capacitance C and an inductance L2. Here, in the extended state, the physical length from the base of the folded antenna element 110 to the tip of the rod-like antenna element 112 is approximately 125 mm, which is longer than a quarter wavelength (83.3 mm) of the first frequency f1, but the coupling capacitance C, which is provided in the middle, shortens the effective length to a quarter of the wavelength of the first frequency f1. Similarly, the coupling capacitance C, provided in the middle, shortens the effective length for the second frequency f2 to three quarters of the wavelength. Therefore, the first frequency f1 and the second frequency f2 are resonated in the antenna extended state, making it possible to transmit and receive. In addition, the effective lengths with respect to the first frequency f1 and the second frequency f2 are a quarter wavelength and a three-quarter wavelength respectively, and the input/output impedance in each case is approximately 50 ohms, which is substantially the same as in the stored state. Consequently, by connecting the freely extendable and storable antenna of the present invention, which has input/output impedance of approximately 50 ohms, to a radio circuit and a coaxial cable having input/output impedance of approximately 50 ohms, signal transmission can be carried out with high efficiency without no adjusting circuit required.

Therefore, the total length of the freely extendable and storable antenna in the stored state is shortened by the reduction in the physical length of the rod-like antenna element 112 in comparison with the previously proposed device, making the antenna of the present invention suitable for use in a small-scale mobile telephone or the like.

The effective lengths of the folded antenna element 110 and the rod-like antenna element 112, with respect to the first frequency f1 and the second frequency f2, can for instance be set according to the following sequence. Firstly, the unfolded physical length from the base to the tip of the folded antenna element 110 is set to approximately a quarter of the wavelength of the first frequency f1, and then this is arranged in zigzag shape. Although floating capacitance occurs between the conductors of the zigzag-shaped folded antenna element 110, this does not greatly affect the low first frequency f1, which resonates. However, this floating capacitance between conductors greatly affects the second frequency f2, considerably shortening the effective length from the base to the tip. Therefore, when the floating capacitance between the conductors is adjusted, for instance by adjusting the spaces between the zigzags and their parallel length and the like, it is possible to set the effective length to three quarters of the wavelength of the second frequency f2.

Next, there will be detailed the method of setting effective lengths for the first frequency f1 and the second frequency f2 in the antenna extended state. In the antenna extended state, resonant frequency is higher when the overlap between the folded antenna element 110 and the rod-like antenna element 112 is increased, consequently increasing the coupling capacitance C; and resonant frequency is lower when the overlap is decreased, consequently reducing the coupling capacitance C. Therefore, the physical length from the base of the folded antenna element 110 to the tip of the rod-like antenna element 112 in the extended state is first set to longer than a quarter of the wavelength of the first frequency f1. Next, the capacitance value of the coupling capacitance C is adjusted by adjusting the overlap between the folded antenna element 110 and the rod-like antenna element 112, and the effective length is set to a quarter of the wavelength of the first frequency f1. Then, in this state, if the frequency which resonates at an effective length of three quarters of the frequency wavelength is higher than the second frequency f2, the overlap between the folded antenna element 110 and the rod-like antenna element 112 is slightly reduced to lower the capacitance value and thereby lower the frequency which is resonant at three quarters wavelength until it matches the second frequency f2. As a result of this adjustment, the frequency which resonates at a quarter wavelength is lowered to less than the first frequency f1, but this has little effect on the second frequency f2. Furthermore, the length of the rod-like antenna element 112 is slightly reduced and the frequency which is resonant at a quarter of the wavelength is raised to match the first frequency f1. As a consequence of this adjustment, the frequency which is resonant at an effective length of three quarters of the wavelength is higher, but this effect is less than that on the first frequency f1. By repeatedly adjusting the coupling capacitance C of the folded antenna element 110 and the rod-like antenna element 112 and the length of the rod-like antenna element 112, it is possible to set the effective length from the base of the folded antenna element 110 to the tip of the rod-like antenna element 112 to a quarter wavelength, for the first frequency f1, and three quarters of a wavelength, for the second frequency f2. Furthermore, in the extended state, the effective length from the base of the folded antenna element 110 to the tip of the rod-like antenna element 112 is set to a quarter of the wavelength of the first frequency f1. In this state, if the frequency which resonates when the effective length is three quarters of the wavelength is lower than the second frequency f2, similar adjustment to the above can be carried out by increasing the overlap between the folded antenna element 110 and the rod-like antenna element 112, lengthening the rod-like antenna element 112, and such like. Mass-production design is based on dimensions obtained by tests following the method described above.

Figure 16A:
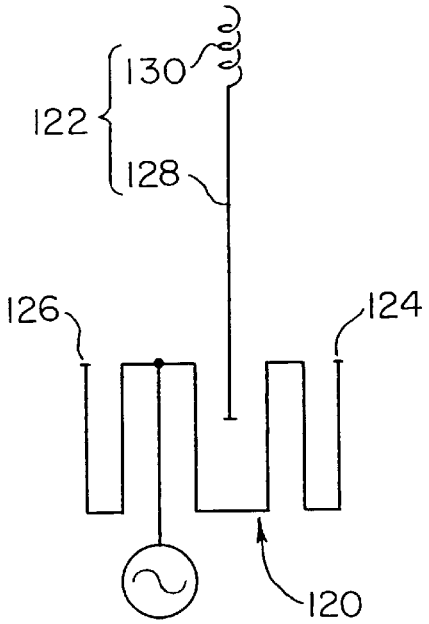
FIG. 16*a* and FIG. 16*b* are diagrams showing a second embodiment of the freely extendable and storable antenna of the present invention, FIG. 16*a* illustrating the antenna extended state, and FIG. 16*b,* the antenna stored state.
Figure 16B:
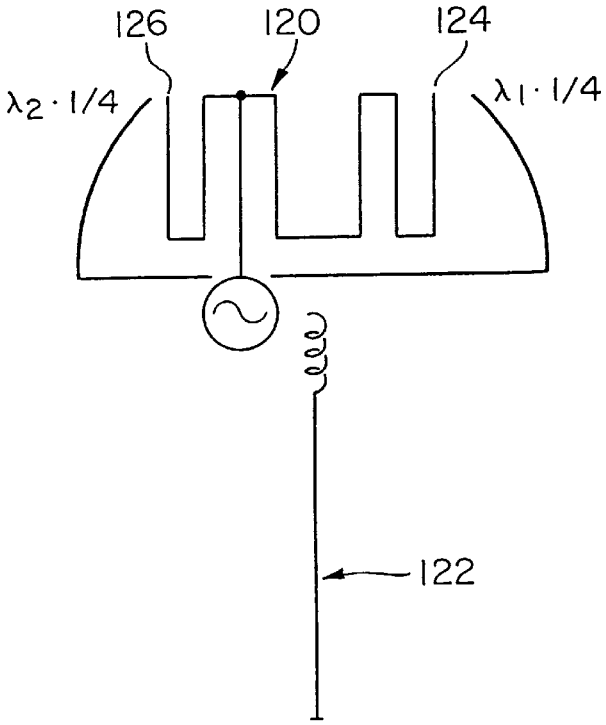

Next, referring to FIG. 16*a* and FIG. 16*b*, a second embodiment of the freely extendable and storable antenna of the present invention will be explained. FIG. 16*a* and FIG. 16*b* are diagrams showing a second embodiment of the freely extendable and storable antenna of the present invention, FIG. 16*a* illustrating the extended state of the antenna, and FIG. 16*b*, the stored state of the antenna.

In FIG. 16*a* and FIG. 16*b*, a rod-like antenna element 122 is provided on the same axis as a cylindrical folded antenna element 120 so as to be freely movable in the axial direction. The folded antenna element 120 of the second embodiment comprises a wire-like or belt-like conductor which is provided in a direction from the base to the tip side, the conductor being folded at least once at the tip side and arranged in zigzag parallel to the above direction, forming a first element 124. In addition, the conductor is split at a first fold point at the tip side from the base, folded at least once, and arranged in zigzag parallel to the above direction, thereby forming a second element 126. Alternatively, the second element 126 may be split at a place between the base and the first fold point at the tip side. Furthermore, the rod-like antenna element 122 comprises a whip antenna element 128 at the base side, and a helical antenna element 130 which is provided on the tip side thereof. Then, in the extended state and the stored state, movement of the rod-like antenna element 122 is, of course, restricted as appropriate to prevent it from slipping out. Moreover, in the extended state, the tip side of the folded antenna element 120 overlaps with the base side of the rod-like antenna element 122, so that the rod-like antenna element 122 becomes inserted therein, restricting its movement in the extend direction.

Then, the effective length of the folded antenna element 120 from the base to the tip of the first element 124 is set to a quarter of the wavelength of the first frequency f1, and the effective length from the base to the tip of the second element 126 is set to three quarters of the wavelength of the second frequency f2. The dimension of the folded antenna element 120 from the base to the first fold point is, by way of example, approximately 25 mm. Then, the dimension of the rod-like antenna element 122 is set shorter than the first embodiment by an amount equivalent to the helical antenna element 130. Furthermore, in the extended state, the base side of the whip antenna element 128, at the base side of the rod-like antenna element 122, overlaps by approximately 10 mm with the tip side of the folded antenna element 120. As a consequence, in the extended state, the physical length from the base of the folded antenna element 120 to the tip of the rod-like antenna element 122 can be set shorter than in the first embodiment.

According to the constitution shown in FIG. 16*a*–FIG. 16*c*, in the antenna stored state, the first element 124 and second element 126 of the folded antenna element 120 resonate the first frequency f1 and the second frequency f2, whereby standby receiving is possible. Furthermore, in the antenna extended state, the effective length from the base of the folded antenna element 120 to the tip of the rod-like antenna element 122 is a quarter of the wavelength of the first frequency f1, and three quarters of the wavelength of the second frequency f2. Moreover, since the folded antenna element 120 comprises the first element 124 and the second element 126, the effective lengths of the first and second elements 124 and 126 can be independently adjusted to a quarter of the wavelength of the first and second frequencies f1 and f2, making adjustment easier. In addition, by providing the helical antenna element 130 to the tip portion of the rod-like antenna element 122, the physical length of the helical antenna element 130 can be shortened, and the total length of the freely extendable and storable antenna in the antenna stored state can be made shorter than the first embodiment.

Figure 17A:
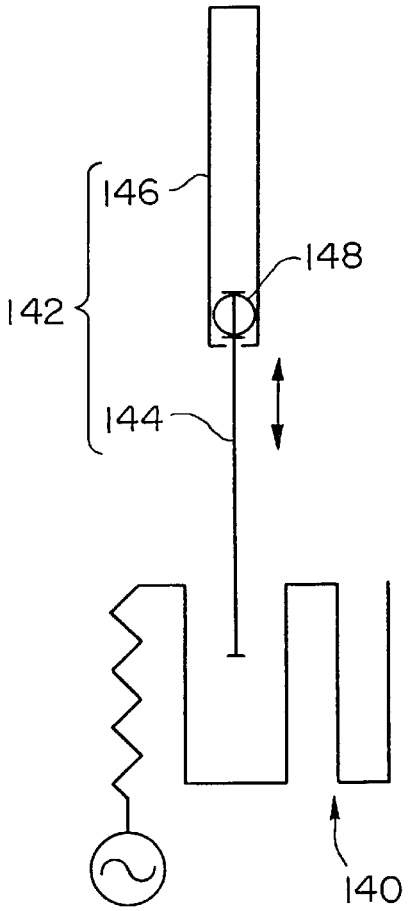
FIG. 17*a* and FIG. 17*b* are diagrams showing a second embodiment of the freely extendable and storable antenna of the present invention, FIG. 17*a* illustrating the antenna extended state, and FIG. 17*b,* the antenna stored state.
Figure 17B:
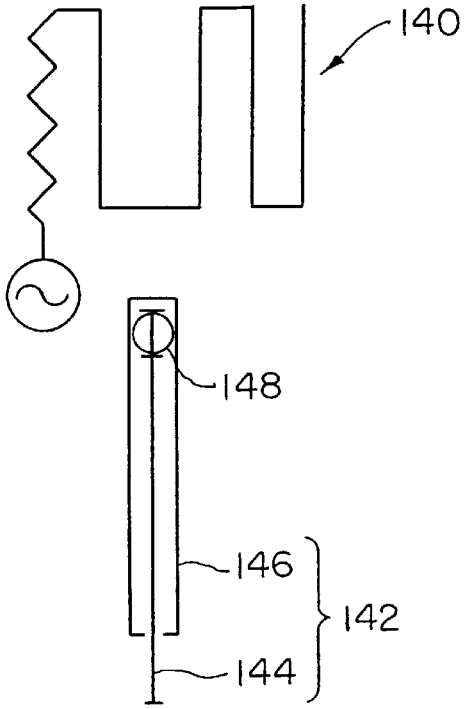

Next, referring to FIG. 17*a* and FIG. 17*b,* a third embodiment of the freely extendable and storable antenna of the present invention will be explained. FIG. 17*a* and FIG. 17*b* are diagrams showing a second embodiment of the freely extendable and storable antenna of the present invention, FIG. 17*a* illustrating the antenna extended state, and FIG. 17*b,* the stored state of the antenna.

In FIG. 17*a* and FIG. 17*b,* a rod-like antenna element 142 is provided on the same axis as a cylindrical folded antenna element 140 so as to be freely movable in the axial direction. The folded antenna element 140 of the third embodiment is similar to the folded antenna element 110 of the first embodiment, but differs in being arranged in zigzag from the base to the first fold point. Furthermore, a whip antenna element 144 is provided at the base side of the rod-like antenna element 142, and a cylindrical antenna element 146 covers the whip antenna element 144 from the tip side thereof, so as to be freely movable in the axial direction like a telescope. In addition, a spring 148 of conductive material is provided at the tip of the whip antenna element 144, and elastically contacts the inner walls of the cylindrical antenna element 146, creating an electrical connection. Then, in the antenna extended state, when the rod-like antenna element 142 is elongated, the effective length from the base of the folded antenna element 140 to the tip of the rod-like antenna element 142 is set to a quarter of the wavelength of the first frequency f1, and three quarters of the wavelength of the second frequency f2. This adjustment is performed in the same manner as in the first embodiment.

According to the constitution shown in FIG. 17*a* and FIG. 17*b,* the first frequency f1 and the second frequency f2 are resonant when the antenna is in the stored state and the extended state, making it possible to transmit and receive. And, in the antenna stored state, since a large portion of the whip antenna element 144 is stored inside the cylindrical antenna element 146, the total length of the rod-like antenna element 142 is shorter.

Figure 18:
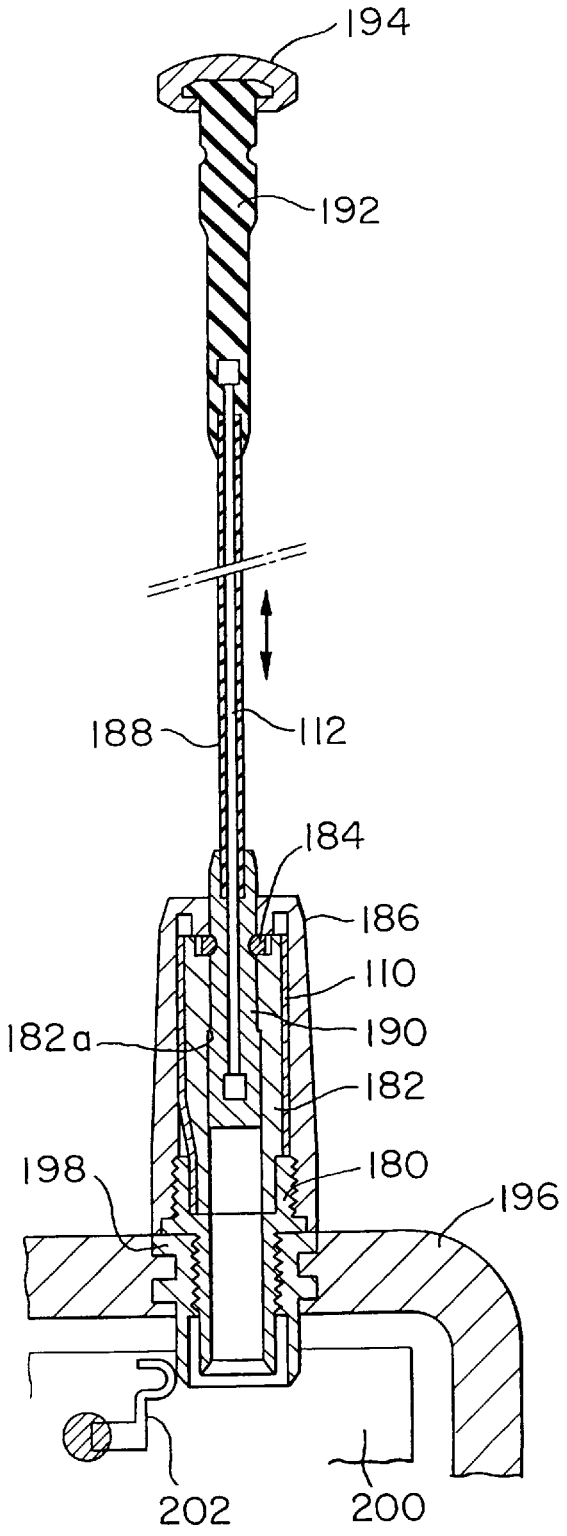
FIG. 18 is a vertical sectional view of primary parts of the freely extendable and storable antenna of the present invention provided in a radio, in the antenna extended state.

Next, the structure of a radio using the above freely extendable and storable antenna will be explained with reference to FIG. 18. FIG. 18 is a vertical sectional view of primary parts of the freely extendable and storable antenna of the present invention provided in a radio in an interference extended state.

In FIG. 18, a cylindrical core member 182, comprising insulating material, is provided to the tip side of a substantially cylindrical supply-feeding metal part 180, comprising conductive material. The folded antenna element 110 of the first embodiment, this being one example, is provided around the outer face of the core member 182, with the base of the folded antenna element 110 electrically connected to the supply-feeding metal part 180 as appropriate, for instance by soldering or the like. Then, a C-shaped resin spring 184 is provided to the tip of the core member 182, and a cap member 186, comprising insulating material, which covers the outer rim of the folded antenna element 110 while restricting the movement of the resin spring 184 in the axial direction, is provided by securely screwing the base side of the cap member 186 onto the supply-feeding metal part 180. A step 182*a,* which has a tip side of smaller radius, is provided on the inner rim of the core member 182.

Furthermore, an insulating tube 188 is provided over a rod-like antenna element 112, comprising a flexible and conductive wire-like body, as for instance shown in the embodiment shown in FIG. 14*a*–FIG. 14*c,* and a stopper 190, comprising insulating material, is provided at the base thereof. An insulating member 192, having the same radius as the stopper 190, is provided at the tip side of the rod-like antenna element 112, and a top member 94 is secured on the tip of the insulating member 192. Then, an assembled body, such as the rod-like antenna element 112, is integrated to another assembled body, such as the folded antenna element 110, so as to be freely movable in the axial direction. Moreover, at the stopper 190, the step 182*a* on the inner rim of the core member 182 prevents the rod-like antenna element 112 from slipping out in the extend direction. In addition, the C-shaped resin spring 184 elastically clips into a groove provided around the outer rim of the stopper 190, restricting movement in the axial direction. Consequently, the extended state is maintained. Furthermore, a top portion 194 prevents movement in the store direction. In addition, the C-shaped resin spring 184 elastically clips into a groove provided around the outer rim of the insulating member 192, restricting movement in the axial direction. Consequently, the stored state is maintained.

Furthermore, a supply-receiving member 198, comprising conductive material, is provided to a radio cabinet 196 through a side wall thereof. Inside the radio cabinet 196, a circuit board 200, for mounting a radio circuit 150 (not shown in FIG. 18) and the like, is provided as appropriate, and a supply plate spring 202, which is provided to the circuit board 200, elastically contacts the supply-receiving member 198, which projects into the radio cabinet 196. The supply plate spring 202 is, of course, electrically connected as appropriate to the radio circuit 150. Here, by screwing the supply-feeding metal part 180 to the supply-receiving part 198, the base of the folded antenna element 110 is electrically connected, via the supply-feeding metal part 180 and the supply-receiving part 198 and the supply plate spring 202, to the radio circuit 150 mounted on the circuit board 200, thereby forming a radio.

The structure of the folded antenna element is not limited to the embodiments described above. It is only necessary that the first frequency f1 and the second frequency f2 can be made resonant by effective lengths of a quarter wavelength or three quarters wavelength. Furthermore, the structure of the rod-like antenna element is not restricted to the embodiments described above. It is only necessary that the exterior is rod-like. Furthermore, the cylindrical antenna element 146 is not restricted to one levels as in the third embodiment, and may comprise multiple levels. Moreover, in the radio shown in FIG. 18, it can easily be understood that, if the supply-feeding metal part 180 and the supply-receiving metal part 198 and the supply plate spring 202 provide the antenna function, the base, which acts as the antenna of the folded antenna element, is not the physical base itself, but the connection point between the supply plate spring 202 and the circuit board 200.

While there have been described what are at present considered to be preferred embodiments of the invention, it will be understood that various modifications may be made thereto, and it is intended that the appended claims cover all such modifications as fall within the true spirit and scope of the invention.

What is claimed is:

1. A folded antenna, comprising:

a first element, comprising a conductor which is provided in a direction from a base of the antenna toward a tip side thereof, said conductor being folded at least once at said tip side and at least once at a base side and arranged parallel to said direction;

a second element, said second element comprising said conductor which is split at a location consisting of one of 1) a point between said base and a first fold point at said tip side; and 2) said first fold point, said second element being folded at least once and arranged parallel to said direction;

the effective length from said base to a tip of said first element being set so that a first frequency resonates, and the effective length from said base to a tip of said second element being set so that a second frequency resonates.

2. A radio using an antenna device, comprising:

a folded antenna according to claim 1, wherein tips of said first and second elements are provided facing a tip side of the antenna, the effective length from said base to a tip of said first element being set to a quarter of a wavelength of said first frequency, and the effective length from said base to a tip of said second element being set to a quarter of a wavelength of said second frequency; and a whip antenna element, which is freely extendable from and storable in said folded antenna along a direction connecting said base and said tip, the effective length from a base of said whip antenna element to a tip thereof being set to half of a wavelength of said first frequency, and the effective length from a base of said whip antenna element to a tip thereof being set to one wavelength of said second frequency; and in said extended state, a base portion of said whip antenna element is capacitance-coupled to a tip portion of said folded antenna; and wherein a supply-feeding metal part is electrically connected to a base side of said folded antenna, provided to the outside of a side wall of a cabinet of the radio, said supply-feeding metal part being provided through a side wall of said cabinet, and electrically connected to a radio circuit housed inside said cabinet.

3. A radio using an antenna device, comprising:

a folded antenna according to claim 1, wherein the effective length from said base to a tip of said first element is set to a quarter of a wavelength of said first frequency, and the effective length from said base to a tip of said second element is set to a quarter of a wavelength of said second frequency;

a whip antenna element, which is freely extendable from and storable in said folded antenna along a direction connecting said base and said tip, and, in said extended state, a base portion of said whip antenna element is capacitance-coupled to said folded antenna, the effective length from a base of said folded antenna to a tip of said whip antenna element, in said extended state, being set to a quarter of a wavelength of said first frequency and three quarters of a wavelength of said second frequency; and wherein a supply-feeding metal part is electrically connected to a base side of said folded antenna, provided to the outside of a side wall of a cabinet of the radio, said supply-feeding metal part being provided through a side wall of said cabinet, and electrically connected to a radio circuit housed inside said cabinet.

4. A folded antenna, comprising:

a first element, comprising a conductor which is provided in a direction from a base of the antenna toward a tip side thereof, said conductor being folded sequentially not less than once at said tip side and at a base side and arranged parallel to said direction;

a second element, said second element comprising said conductor which is split at a location consisting of one of 1) a point between said base and a first fold point at said tip side; and 2) said first fold point, said second element being folded sequentially not less than once at said tip side and said base side and arranged parallel to said direction;

the effective length from said base to a tip of said first element being set so that a first frequency resonates, and the effective length from said base to a tip of said second element being set so that a second frequency resonates.

5. The folded antenna according to claim 1 or 4, wherein said conductor is provided in zigzag from said base to a first fold point at said tip side.

6. The folded antenna according to claim 1 or 4, wherein the effective length for said first frequency, from said base to a tip of said first element, and the effective length for said second frequency, from said base to a tip of said second element, are set so that their respective input/output impedances at said base are substantially the same.

7. The folded antenna according to claim 1 or 4, further comprising:

a third element, in which said conductor is split at said tip side and arranged in said direction, the effective length from said base to a tip of said third element being set so that a separate frequency resonates.

8. The folded antenna according to claim 1 or 4, wherein, for a first frequency, the effective length from said base to a tip of said first element is set to a quarter of a wavelength; and for a separate frequency, the effective length from said base to said first fold point is set to a quarter of a wavelength, and the effective length from said base to a tip of said first element is set to three quarters of a wavelength.

9. The folded antenna according to claim 1 or 4, wherein the folded antenna is provided in a shape of a cylinder having as its axis a direction from said base to a tip side.

10. The folded antenna according to claim 1 or 4, wherein said elements are formed by press-stamping of seal material and are pasted over the rim of a core member using covering tape.

11. An antenna device, comprising:

a folded antenna according to claim 1 or 4, wherein tips of said first and second elements are provided facing a tip side of the antenna, the effective length from said base to a tip of said first element being set to a quarter of a wavelength of said first frequency, and the effective length from said base to a tip of said second element being set to a quarter of a wavelength of said second frequency;

a helical antenna element, which is provided at a tip of a whip antenna element on a same axis thereto, said whip antenna element and said helical antenna element being freely extendable from and storable in said folded antenna, along a direction connecting said base and said tip, the effective length from a base of said whip antenna element to a tip of said helical antenna element being set to a quarter of a wavelength of said first frequency, and the effective length from a base of said whip antenna element to a tip thereof being set to half of a wavelength of said second frequency; and in said extended state, a base portion of said whip antenna element is capacitance-coupled to a tip portion of said folded antenna.

12. A radio using an antenna device according to claim 11, wherein a supply-feeding metal part is electrically connected to a base side of said folded antenna, provided to the outside of a side wall of a cabinet of the radio, said supply-feeding metal part being provided through a side wall of said cabinet, and electrically connected to a radio circuit housed inside said cabinet.

13. The radio according to claim 12, wherein the radio is a device used near to the side of a user's head, and a conductor, arranged from a base of said folded antenna to a first fold point, is provided at a side of said cabinet which is opposite to said side which is close to the side of a user's head.

14. The antenna device according to claim 11, wherein, in said extended state, a coupling capacitance between a tip of either one of said first and second elements, which resonates the lower frequency of said first and second frequencies, and a base portion of said whip antenna element, is smaller than a coupling capacitance between another tip and said base portion of said whip antenna element.

15. A radio using an antenna device according to claim 14, wherein a supply-feeding metal part is electrically connected to a base side of said folded antenna, provided to the outside of a side wall of a cabinet of the radio, said supply-feeding metal part being provided through a side wall of said cabinet, and electrically connected to a radio circuit housed inside said cabinet.

16. An antenna device, comprising:

a folded antenna according to claim 1 or 4, wherein tips of said first and second elements are provided facing a tip side of the antenna, the effective length from said base to a tip of said first element being set to a quarter of a wavelength of said first frequency, and the effective length from said base to a tip of said second element being set to a quarter of a wavelength of said second frequency; and a whip antenna element, which is freely extendable from and storable in said folded antenna along a direction connecting said base and said tip, the effective length from a base of said whip antenna element to a tip thereof being set to half of a wavelength of said first frequency, and the effective length from a base of said whip antenna element to a tip thereof being set to one wavelength of said second frequency; and in said extended state, a base portion of said whip antenna element is capacitance-coupled to a tip portion of said folded antenna.

17. An antenna device, comprising:

a folded antenna according to claim 1 or 4, wherein the effective length from said base to a tip of said first element is set to a quarter of a wavelength of said first frequency, and the effective length from said base to a tip of said base to a tip of said second element is set to a quarter of a wavelength of said second frequency;

a whip antenna element, which is freely extendable from and storable in said folded antenna along a direction connecting said base and said tip, and, in said extended state, a base portion of said whip antenna element is capacitance-coupled to said folded antenna, the effective length from a base of said folded antenna to a tip of said whip antenna element, in said extended state, being set to a quarter of a wavelength of said first frequency and three quarters of a wavelength of said second frequency.

18. A radio using an antenna device, comprising:

a folded antenna according to claim 4, wherein tips of said first and second elements are provided facing a tip side of the antenna, the effective length from said base to a tip of said first element being set to a quarter of a wavelength of said first frequency, and the effective length from said base to a tip of said second element being set to a quarter of a wavelength of said second frequency; and a whip antenna element, which is freely extendable from and storable in said folded antenna along a direction connecting said base and said tip, the effective length from a base of said whip antenna element to a tip thereof being set to half of a wavelength of said first frequency, and the effective length from a base of said whip antenna element to a tip thereof being set to one wavelength of said second frequency; and in said extended state, a base portion of said whip antenna element is capacitance-coupled to a tip portion of said folded antenna; and wherein a supply-feeding metal part is electrically connected to a base side of said folded antenna, provided to the outside of a side wall of a cabinet of the radio, said supply-feeding metal part being provided through a side wall of said cabinet, and electrically connected to a radio circuit housed inside said cabinet.

19. A radio using an antenna device, comprising:

a folded antenna according to claim 4, wherein the effective length from said base to a tip of said first element is set to a quarter of a wavelength of said first frequency, and the effective length from said base to a tip of said second element is set to a quarter of a wavelength of said second frequency;

a whip antenna element, which is freely extendable from and storable in said folded antenna along a direction connecting said base and said tip, and, in said extended state, a base portion of said whip antenna element is capacitance-coupled to said folded antenna, the effective length from a base of said folded antenna to a tip of said whip antenna element, in said extended state, being set to a quarter of a wavelength of said first frequency and three quarters of a wavelength of said second frequency; and wherein a supply-feeding metal part is electrically connected to a base side of said folded antenna, provided to the outside of a side wall of a cabinet of the radio, said supply-feeding metal part being provided through a side wall of said cabinet, and electrically connected to a radio circuit housed inside said cabinet.

20. A freely extendable and storable antenna, comprising:

a folded antenna element, comprising a first element, which comprises a conductor provided in a direction from a base toward a tip side, said conductor being folded at least once at said tip side and arranged parallel to said direction, and a second element, said second element comprising said conductor split at a location consisting of one of 1) a point between said base and a first fold point at said tip side; and 2) said first fold point, said second element being folded at least once and arranged parallel to said direction, the effective length of said folded antenna element from said base to a tip of said first element being set to a quarter of a wavelength of a first frequency, and the effective length from said base to a tip of said second element being set to a quarter of a wavelength of a second frequency; and a rod-like antenna element, provided so as to be freely movable along an axis direction of said folded antenna element, which is given a cylindrical shape; wherein when said rod-like antenna element is in an extended state, a base side of said rod-like antenna element is capacitance-coupled to a tip side of said cylindrical folded antenna element in a state of insertion therein, the effective length from a base of said folded antenna element to a tip of said rod-like antenna element being set to a quarter of a wavelength of said first frequency and three quarters of a wavelength of said second frequency.

21. The freely extendable and storable antenna according to claim 20, wherein said rod-like antenna element comprises a whip antenna element and a helical antenna element provided on a tip side of said rod-like antenna element.

22. The freely extendable and storable antenna according to claim 20, wherein said rod-like antenna element comprises a whip antenna element and a cylindrical antenna element, covering a tip side of said whip antenna element, and freely movable along an axial direction thereof.

23. The freely extendable and storable antenna according to claim 20, wherein, when said rod-like antenna element is in a stored state, no electrical coupling occurs between a tip side of said rod-like antenna element and said folded antenna element.

24. The freely extendable and storable antenna according to claim 20, wherein, when said rod-like antenna element is in a stored state, capacitance coupling and dielectric coupling occurs between a tip side of said rod-like antenna element and said folded antenna element, but the effective length from a base of said folded antenna element to a base of said rod-like antenna element is set so that frequencies within a frequency band of said first frequency and said second frequency are not resonant.

25. The freely extendable and storable antenna according to claim 20, wherein said antenna elements are formed by press-stamping of seal material and are pasted over the rim of a core member using covering tape.

26. A radio, using a freely extendable and storable antenna according to claim 20, wherein a supply-feeding metal part is electrically connected to a base side of said folded antenna, provided to the outside of a side wall of a cabinet of the radio, said supply-feeding metal part being provided through a side wall of said cabinet, and electrically connected to a radio circuit housed inside said cabinet.

* * * * *